United States Patent [19]

Herz

[11] 4,061,196

[45] Dec. 6, 1977

[54] RESILIENT YOKE MOUNTINGS FOR VIBRATORY PILE DRIVERS AND EXTRACTORS

[75] Inventor: Alvin E. Herz, Lakeland, Fla.

[73] Assignee: L. B. Foster Company, Coraopolis, Pa.

[21] Appl. No.: 718,877

[22] Filed: Aug. 30, 1976

[51] Int. Cl.[2] ..... E02D 7/18

[52] U.S. Cl. ..... 173/49; 173/162

[58] Field of Search ..... 173/49, 162, 139; 267/137, 152; 248/9, 18

[56] References Cited

U.S. PATENT DOCUMENTS

| | | | |
|---|---|---|---|
| 1,888,333 | 11/1932 | Terry | 267/137 |
| 3,502,160 | 3/1970 | Herz | 173/49 |
| 3,828,864 | 8/1974 | Haverkamp et al. | 173/49 |

FOREIGN PATENT DOCUMENTS

| | | | |
|---|---|---|---|
| 2,140,728 | 2/1972 | Germany | 267/152 |

*Primary Examiner*—Robert A. Hafer

*Attorney, Agent, or Firm*—Buell, Blenko & Ziesenheim

[57] ABSTRACT

A vibratory pile driver and extractor is provided in combination with a yoke means above and movable relative to said driver and extractor and resilient rubber support means between opposed abutments on said driver and extractor and said yoke means whereby said driver and extractor is resiliently connected to said yoke means through said abutments, said abutments acting to prevent separation of the yoke means and driver and extractor in case of failure of the resilient rubber means.

7 Claims, 4 Drawing Figures

RESILIENT YOKE MOUNTINGS FOR VIBRATORY PILE DRIVERS AND EXTRACTORS

This invention relates to resilient yoke mountings for vibratory pile drivers and extractors and particularly to a combined vibratory pile driver and extractor and a yoke isolated from the vibrations of the pile driver and extractor by a plurality of rubber connectors.

The desirability of isolating the lifting yoke from the vibratory mechanism of vibratory pile drivers and extractors has long been recognized. In my earlier U.S. Pat. No. 3,502,160, issued Mar. 24, 1970, I disclose an arrangement in which this is accomplished by two separate sets of springs. Another arrangement is disclosed in Haverkamp et al. U.S. Pat. No. 3,828,864, issued Aug. 13, 1974. Unfortunately, however, both of these arrangements have drawbacks which make them less than completely satisfactory. In the case of my earlier U.S. Pat. No. 3,502,160 the springs are very noisy and under certain conditions the crescendo of sound coming from them reaches the proportions of a scream. In addition the springs can and do destroy themselves if the vibratory driver happens to reach a frequency which excites them. The arrangement of U.S. Pat. No. 3,828,864 eliminates some problems of my earlier U.S. Pat. No. 3,502,160, particularly in the area of noise level, however, it has new problems of its own. In U.S. Pat. No. 3,828,864 the yoke and vibratory unit are connected by torsion discs whose axis is perpendicular to the driven or extraction movement. In this arrangement the discs are always under torsion and there is no way in which they can be relieved. Moreover, if one of the discs should break loose, the alignment of the machine is immediately affected as is its safety.

In the present invention I have provided a vibratory drive and yoke arrangement in which all of the problems of the prior art devices are eliminated. The apparatus of this invention has a longer life, is free of noise, involves much less maintainence, less down time and absorbs frequency changes to a degree not possible with the prior art devices.

I provide in combination a vibratory pile driver and extractor including a body assembly having at its lower end engaging means engaging a pile to be driven or extracted, and transmitting vibrations to said pile generated by rotating eccentric weights on said body, yoke means above and movable relative to said body assembly, said yoke means including at its upper part means adapted for attachment to a hoisting cable, a pair of horizontal abutment means on one of said body assembly and yoke and horizontal abutment on the other of said body assembly and yoke spaced from and intermediate said pair of horizontal abutment means and resilient rubber support means between said pair of horizontal abutment means and said horizontal abutment means. Preferably adjustment means are provided on at least one of said pair of abutment means for preloading said resilient rubber means.

In the foregoing general outline of my invention I have set out certain objects, purposes and advantages of my invention. Other objects, purposes and advantages of this invention will be apparent from the following description and the accompanying drawings in which.

Figure 1:
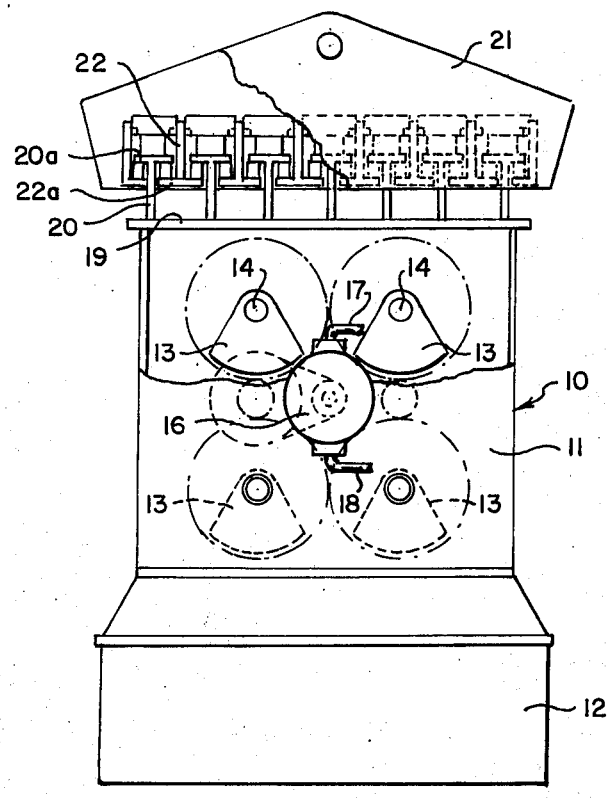
FIG. 1 is a side elevational view; partly in section, of a combined vibratory pile driver and extractor, partly broken away to show a fragmentary view of one form of resilient mounting of this invention.

Referring to the drawings and particularly to FIG. 1, I have illustrated a conventional combination pile driver and extractor body assembly 10, having a transmission cover 11 with a gripper head 12 rigidly attached thereto and adapted to engage and grip the upper end of a pile (not shown) which is to be driven or extracted. On the transmission cover 11 are mounted a plurality of eccentric weights 13 which revolve in opposite directions in phase synchronization on horizontal shafts 14. The revolving eccentric weights 13 thus produce vibrations which are directed in vertically up and down directions, with all others being essentially cancelled out. Hydraulic motor 16 for rotating the eccentric drivers is mounted on the ends of shafts 14. These motor and drivers are not illustrated in detail because they are conventional and well known. Fluid supply lines 17–18 are attached to each motor to furnish fluid from a conventional source in well known manner and thus not illustrated.

Figure 1A:
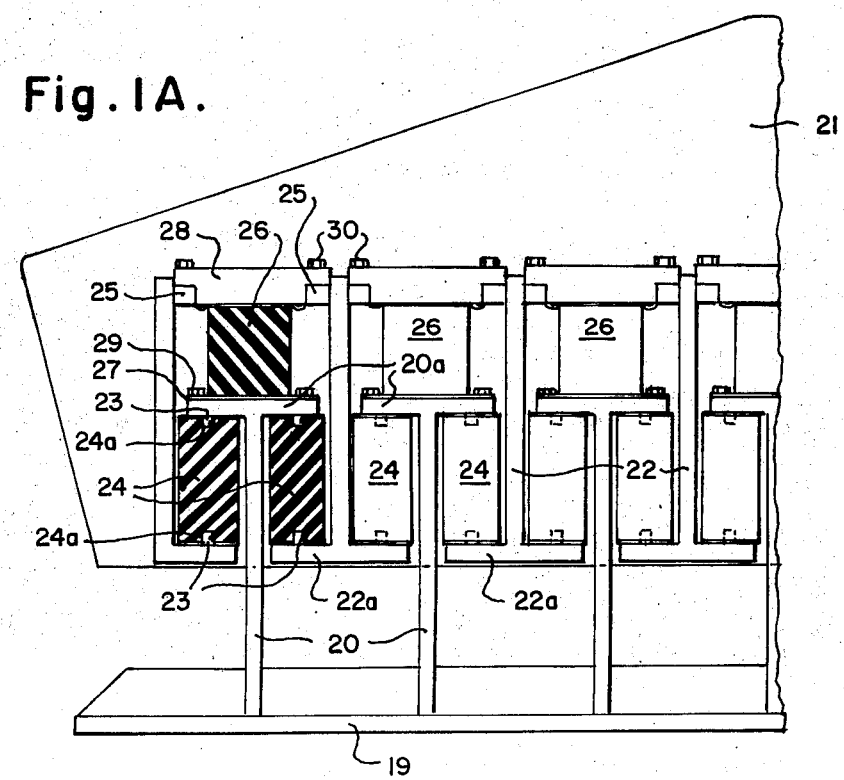
FIG. 1A is a fragmentary view to enlarged scale of the resilient mounting shown in FIG. 1.

Viewing FIG. 1A a plurality of vertically extending T arms 20 in two parallel rows are spaced along the top 19 of the transmission cover 11. A yoke assembly 21 having a like pair of parallel rows of inverted T arms 22 is inserted between the arms 20 on cover 11. Each of the T heads **20*a* and 22*a* has on each side at least one projecting pin 23 receiving a rubber block 24 having openings 24*a* receiving pins 23 to position the rubber blocks 24 and hold them in place between the opposing T heads 20*a* and 22*a*. The T heads 20*a* and 22*a* act as abutments against which the rubber blocks 24 act to isolate the body 10 from yoke 21 during extraction. Each of the inverted T arms 22 has, on each side of the base of its vertical arm, a pair of opposed flanges 25. A rubber block 26 bonded to a base plate 27 and a head plate 28 is inserted between each pair of adjacent T arms 22 with base plate 27 fastened to the top of T heads 20 by bolts 29. Head plate 28 is in turn fastened to flanges 25 on adjacent T arms by bolts 30. The rubber blocks 26 support the yoke assembly 21 during driving of a pile. Preloading of the rubber blocks 24 and 26 can be adjusted by shims on bolts 30**.

Figure 2:
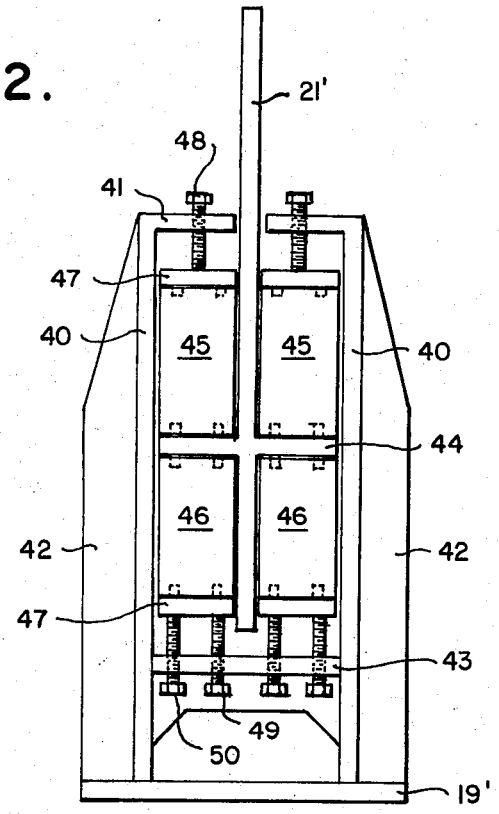
FIG. 2 is a vertical section through a second embodiment of this invention.

In the embodiment of FIG. 2 I have illustrated another modification of my invention in which yoke 21' is vertically movable between spaced vertical plates 40 fixed at their bottom edge to transmission cover 19' and at the upper edge having a horizontal flange 41 extending toward the yoke 21'. Reinforcing ribs 42 are provided on the outside of plates 40. The two plates 40 are connected by a connector plate 43 adjacent their bottom. The yoke 21' has transverse ribs or abutments 44 extending along opposite sides intermediate flange 41 and connector plate 43. Each rib 44 carries resilient rubber blocks 45 and 46 one above and one below. Each rubber block has a bearing plate 47 on the surface opposite its connection with the rib 44. Adjustment bolts 48 in flange 41 and adjustment bolts 49 and 50 in connector plate 43 bear against bearing plates 47 on blocks 45 and 46 respectively so that the blocks can be positioned and preloaded as desired.

Figure 3:
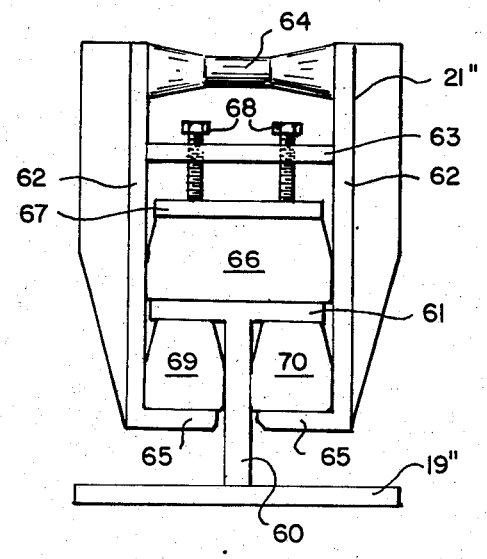
FIG. 3 is a vertical section through a third embodiment of this invention.

FIG. 3 illustrates a third embodiment in which a vertical plate 60 is fixed at one end centrally and lengthwise of transmission cover 19''. A transverse plate 61 on top of plate 60 forms a T-shaped member. A yoke 21" is formed by spaced parallel plates 62 connected by an upper connector plate 63 extending parallel to the transmission cover 19" and spacing plates 62 apart a distance slightly greater than the width of transverse plate 61. A lift bar 64 connects plates 62 at their top. Each plate 62 is provided with a bottom flange 65 inturned toward vertical plate 62. A rubber block 66 covering the top of plate 61 extends lengthwise between plate 21 and connector plate 63. Block 66 is provided with a bearing plate 67 against which adjustment screws 68 in connector plate 63 bear. Rubber blocks 69 and 70 extend between transverse plate 61 and flange 65. Again the rubber blocks 66, 69, and 70 may be preloaded by screws 68.

In the foregoing structures all of the problems of present vibratory driver and extractor combinations with yokes are eliminated. In addition, this structure provides longer life with fewer adjustments and no chance of a dangerous separation of yoke and driver occuring during use.

While I have illustrated and described certain presently preferred practices and embodiments of my invention in the foregoing specification, it will be understood that this invention may be otherwise embodied within the scope of the following claims.

I claim:

1. In combination a vibratory pile driver and extractor including a body assembly having at its lower end engaging means engaging a pile to be driven or extracted and transmitting vibration to said pile generated by rotating eccentric weights on said body, yoke means above and movable relative to said body assembly, said yoke means including at its upper part means adapted for attachment to a hoisting cable, a pair of first horizontal abutment means in the same plane on each of said body assembly and yoke and a second horizontal abutment means on the other of said body assembly and yoke, said first and second horizontal abutment means being spaced apart vertically and resilient rubber support means between said each of said pair of horizontal abutment means and said horizontal abutment means whereby said body assembly and yoke are resiliently connected through said rubber support means and the said abutment.

2. A vibratory pile driver and extractor apparatus as claimed in claim 1 wherein adjustment means are provided on at least one of said pair of abutment means acting on said resilient rubber means for preloading the same.

3. In combination a vibratory pile driver and extractor including a body assembly having at its lower end engaging means engaging a pile to be driven or extracted and transmitting vibration to said pile generated by rotating eccentric weights on said body, yoke means above and movable relative to said body assembly, said yoke means including at its upper part means adapted for attachment to a hoisting cable, a pair of first horizontal abutment means on one of said body assembly and yoke and a second horizontal abutment means on the other of said body assembly and yoke, said first and second horizontal abutment means being spaced apart vertically and resilient rubber support means between said each of said pair of horizontal abutment means and said horizontal abutment means whereby said body assembly and yoke are resiliently connected through said rubber support means and the said abutment, and wherein the yoke means is a vertical plate provided with spaced inverted T shaped members having flanges on opposite sides of the end of the vertical member of said inverted T and extending parallel to the T head, a plurality of T-shaped members extending vertically above the body assembly in two parallel spaced lines, one on each side of the yoke with the head of each T-shaped member lying between the head and flange of the T-shaped member, and resilient rubber blocks between each of the two T heads and the flanges.

4. In combination a vibratory pile driver and extractor including a body assembly having at its lower end engaging means engaging a pile to be driven or extracted and transmitting vibration to said pile generated by rotating eccentric weights on said body, yoke means above and movable relative to said body assembly, said yoke means including at its upper part means adapted for attachment to a hoisting cable, a pair of first horizontal abutment means on one of said body assembly and yoke and a second horizontal abutment means on the other of said body assembly and yoke, said first and second horizontal members being spaced apart vertically and resilient rubber support means between said each of said pair of horizontal abutment means and said horizontal abutment means whereby said body assembly and yoke are resiliently connected through said rubber support means and the said abutment, wherein the yoke means is a vertical plate having a pair of horizontal opposed ribs one on each side intermediate top and bottom of the yoke and the body assembly has a pair of vertical spaced apart plates on the top, one on each side of said yoke, a flange along the top edge of each plate extending toward the yoke and a connector plate connecting said vertical plates below the yoke, said ribs on the yoke lying between said connector plate and said flanges, and resilient rubber block means between each rib and the connector means and between each flange and each rib.

5. A vibratory pile driver and extractor apparatus as claimed in claim 4 having adjustment means on each of said connector plate and said flanges acting on said resilient rubber block means whereby said rubber block means are preloaded.

6. In combination a vibratory pile driver and extractor including a body assembly having at its lower end engaging means engaging a pile to be driven or extracted and transmitting vibration to said pile generated by rotating eccentric weights on said body, yoke means above and movable relative to said body assembly, said yoke means including at its upper part means adapted for attachment to a hoisting cable, a pair of first horizontal abutment means on one of said body assembly and yoke and a second horizontal abutment means on the other of said body assembly and yoke, said first and second horizontal members being spaced apart vertically and resilient rubber support means between said each of said pair of horizontal abutment means and said horizontal abutment means whereby said body assembly and yoke are resiliently connected through said rubber support means and the said abutment, wherein the yoke means is a pair of spaced apart parallel vertical plates having a transverse connector plate intermediate their top and bottom, a lift member at the top and a pair of inturned flanges at their bottom parallel to the connector plate and the body assembly carries a T-shaped member on top lying between said yoke plates with the top of the T between the connector plate and flanges and resilient rubber means between each flange and the top of the T-shaped member and between the top of the T-shaped member and the connector plate.

7. A vibratory pile driver and extractor apparatus as claimed in claim 6 having adjustment means on the connector plate acting on the resilient rubber means to preload the same.

* * * * *

UNITED STATES PATENT AND TRADEMARK OFFICE

CERTIFICATE OF CORRECTION

PATENT NO. : 4,061,196

DATED : December 6, 1977

INVENTOR(S) : Alvin E. Herz

It is certified that error appears in the above-identified patent and that said Letters Patent are hereby corrected as shown below:

The title page should be deleted to insert the attached title page therefor.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*

United States Patent [19]

Herz

[11] 4,061,196

[45] Dec. 6, 1977

[54] RESILIENT YOKE MOUNTINGS FOR VIBRATORY PILE DRIVERS AND EXTRACTORS

[75] Inventor: Alvin E. Herz, Lakeland, Fla.

[73] Assignee: L. B. Foster Company, Coraopolis, Pa.

[21] Appl. No.: 718,877

[22] Filed: Aug. 30, 1976

[51] Int. Cl.[2] ..... E02D 7/18

[52] U.S. Cl. ..... 173/49; 173/162

[58] Field of Search ..... 173/49, 162, 139; 267/137, 152; 248/9, 18

[56] References Cited

U.S. PATENT DOCUMENTS

| | | | |
|---|---|---|---|
| 1,888,333 | 11/1932 | Terry | 267/137 |
| 3,502,160 | 3/1970 | Herz | 173/49 |
| 3,828,864 | 8/1974 | Haverkamp et al. | 173/49 |

FOREIGN PATENT DOCUMENTS

| | | | |
|---|---|---|---|
| 2,140,728 | 2/1972 | Germany | 267/152 |

*Primary Examiner*—Robert A. Hafer

*Attorney, Agent, or Firm*—Buell, Blenko & Ziesenheim

[57] ABSTRACT

A vibratory pile driver and extractor is provided in combination with a yoke means above and movable relative to said driver and extractor and resilient rubber support means between opposed abutments on said driver and extractor and said yoke means whereby said driver and extractor is resiliently connected to said yoke means through said abutments, said abutments acting to prevent separation of the yoke means and driver and extractor in case of failure of the resilient rubber means.

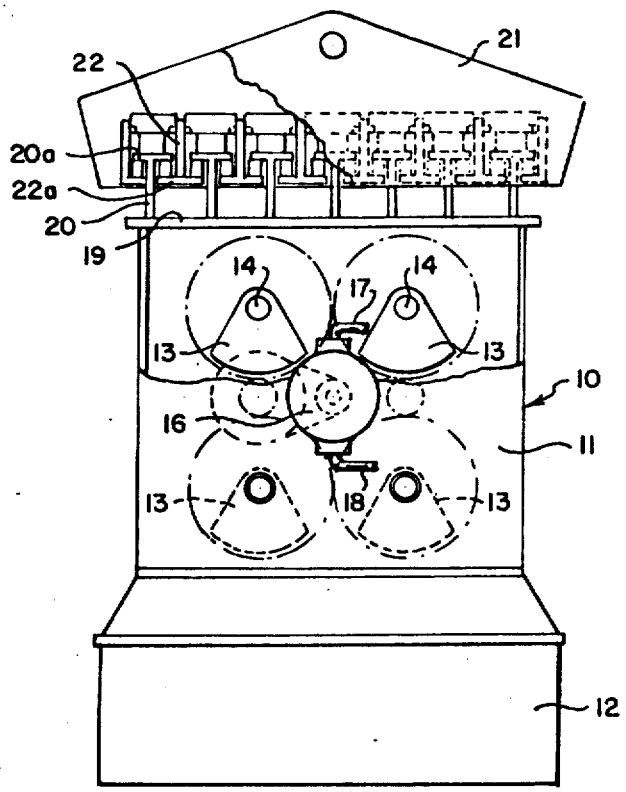

7 Claims, 4 Drawing Figures